US009802409B2

(12) United States Patent
Yamabe

(10) Patent No.: US 9,802,409 B2
(45) Date of Patent: Oct. 31, 2017

(54) ADJUSTMENT MECHANISM AND ADJUSTMENT METHOD

(71) Applicant: MIMAKI ENGINEERING CO., LTD., Nagano (JP)

(72) Inventor: Katsutoshi Yamabe, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/153,726

(22) Filed: May 12, 2016

(65) Prior Publication Data

US 2016/0332442 A1 Nov. 17, 2016

(30) Foreign Application Priority Data

May 15, 2015 (JP) ..... 2015-100485

(51) Int. Cl.
*B41J 25/34* (2006.01)
*B41J 25/00* (2006.01)
*B41J 2/145* (2006.01)

(52) U.S. Cl.
CPC ..... *B41J 2/145* (2013.01); *B41J 25/001* (2013.01); *B41J 25/34* (2013.01); *B41J 2202/14* (2013.01)

(58) Field of Classification Search
CPC . B41J 2/145; B41J 25/001; B41J 25/34; B41J 25/00; B41J 25/3086; B41J 25/308; B41J 2/135; B41J 2202/14
See application file for complete search history.

(56) References Cited

U.S. PATENT DOCUMENTS

2009/0201332 A1 8/2009 Kobayashi et al.
2010/0315469 A1 12/2010 Nishino
2012/0019592 A1* 1/2012 Chang ..... B41J 2/155 347/37

FOREIGN PATENT DOCUMENTS

JP 2011093174 5/2011
WO 2010101034 9/2010

OTHER PUBLICATIONS

"Search Report of Euorpe Counterpart Application" , dated Sep. 15, 2016, p1-p8, in which the listed references were cited.

* cited by examiner

*Primary Examiner* — Geoffrey Mruk
(74) *Attorney, Agent, or Firm* — JCIPRNET

(57) ABSTRACT

An adjustment mechanism is structured to adjust and fix a liquid discharge head in position on a base plate. The adjustment mechanism includes a first plate, a second plate, a pivotable cam, and a first biasing unit. The first plate is changeable in position in a circumferential direction relative to the base plate. The first plate is fixed to the base plate. The second plate is mounted on the first plate movably relative to the first plate in a direction different from the circumferential direction. The liquid discharge head is fixed to the second plate. A first biasing unit biases the second plate toward the pivotable cam in a horizontal direction to prevent the second plate from lifting upward off the first plate. The pivotable cam is operable to move the second plate against an biasing force of the first biasing unit and to locate the second plate.

9 Claims, 13 Drawing Sheets

ADJUSTMENT MECHANISM AND ADJUSTMENT METHOD

CROSS REFERENCE TO RELATED APPLICATIONS

This application claims the priority benefit of Japanese Patent Application No. 2015-100485, filed on May 15, 2015. The entirety of the above-mentioned patent application is hereby incorporated by reference herein and made a part of this specification.

TECHNICAL FIELD

This disclosure relates to an adjustment mechanism and an adjustment method for use in adjusting the position of a liquid discharge head.

RELATED ART

Conventionally, various kinds of adjustment mechanisms are employed to adjust the positions of liquid discharge heads on a carriage in a planar direction (for example, see Patent literature 1). The adjustment mechanism described in Patent literature 1 adjusts the positions of liquid discharge heads in X and Y directions by adjusting, using an L-shaped member and an adjusting screw, the position of an X-adjustment plate in the X direction relative to a head plate, and then pivoting the X-adjustment plate with the protrusion of a Θ adjustment plate being pressed against an arc-shaped portion of the X-adjustment plate.

Patent Literature 1: JP 2011-93174A

The adjustment mechanism described in Patent Literature 1 is constructed of a large number of components associated with position adjustments, necessitating intricate assembling steps. In addition to that, fine adjustments are fraught with the trouble of tightening and loosening the screw over times, and further involve the risk that manipulating the screw may end up with another misalignment.

SUMMARY

The present disclosure is made in view of the above described circumstances, and this disclosure provides an adjustment mechanism and an adjustment method that may facilitate position adjustments.

In order to solve the above described problems, an adjustment mechanism according to the present disclosure is an adjustment mechanism that positionally adjusts and fix a liquid discharge head to a component-fixable member and includes: a first plate, being changeable in position in a horizontal direction relative to the component-fixable member, and the first plate is fixable to the component-fixable member; a second plate, being mountable on the first plate and movable in the horizontal direction relative to the first plate, and the second plate being structured to have the liquid discharge head be securely fitted therein; a first biasing unit, being attachable to one end part of the second plate, and the first biasing unit having a lift-off preventer operable to bias the second plate in the horizontal direction and to deter the second plate from lifting upward off the first plate; and a moving member, being attachable to another end part of the second plate, and the moving member being operable to move the second plate against an biasing force of the first biasing unit and to locate the another end part.

In this disclosure, the moving member operable to move and locate the second plate against the biasing force of the first biasing unit is provided, and the first biasing unit structured to bias the second plate toward the moving member and to deter the second plate from lifting upward off the first plate is further provided. The first biasing unit biases the second plate toward the moving member and the first plate, and the moving member moves the second plate against the biasing force of the first biasing unit to positionally adjust and locate the second plate. Thus, the position of the second plate, i.e., liquid discharge head, may be adjustable. The position adjustment of the second plate, i.e., liquid discharge head, may be effected by way of adjustments using the moving member. Therefore, the number of components may be reduced and thus assembling can be readily performed, and the position adjustment thereby may be easier to perform.

In the adjustment mechanism, preferably, the second plate with the liquid discharge head fitted therein is mounted on the first plate, and the first plate is mounted on the component-fixable member so as to have the first plate, the second plate, and the liquid discharge head be fixed to the component-fixable member.

In this disclosure, the first plate, second plate, and liquid discharge head are thus assembled together. This may facilitate assembling and removal of these components, reducing any space required for assembling and thereby saving more space for a carriage and, possibly, other components.

The adjustment mechanism preferably further includes: support members, being disposed on the first plate and spaced at an interval along a second horizontal direction intersecting with the direction in which the second plate is moved by the moving member, and the support members having the second plate be located therebetween to regulate movement of the second plate in the second horizontal direction, wherein the second plate is adjusted in position in the horizontal direction by the moving member between the support members spaced at an interval along the second horizontal direction.

In the adjustment mechanism of this disclosure, while the first biasing unit presses the second plate toward the first plate in the horizontal direction, the second plate is supported between the support members. Therefore, fine position adjustments of the second plate by the moving member may be exercised along the horizontal direction. This may enhance the reliability of position adjustment of the second plate.

In the adjustment mechanism, preferably, at least one of the support members spaced at an interval along the second horizontal direction is a second biasing unit that biases the second plate toward the other support member along the second horizontal direction.

In the adjustment mechanism of this disclosure, the second plate is held between at least one of the support members, i.e., second biasing unit, and the other support member. Then, movements of the second plate along the second horizontal direction may be regulated with certainty irrespective of dimensional accuracy of the second plate. The first biasing unit biases the second plate in the first horizontal direction, and the second biasing unit biases the second plate in the second horizontal direction. These biasing actions may enable more reliable positioning of the second plate relative to the first plate, leading to an improved positioning accuracy of the liquid discharge head.

In the adjustment mechanism, preferably, the first biasing unit includes: a pressing member that presses the second plate; and an biasing force generator that biases the pressing member toward the second plate, wherein the pressing member is slidably attachable to the first plate along the horizontal direction through a slide groove formed in the first plate, the pressing member being prevented from falling off the first plate by the slide groove, and a lower surface of the pressing member is flush with a lower surface of the first plate or above the level of the lower surface of the first plate.

This disclosure provides the pressing member, as a structural element of the first biasing unit, slidably attachable to the first plate by the slide groove. Further, the pressing member may be prevented from falling off the first plate by the slide groove. With the aid of this pressing member, the second plate may be more reliably pressed toward the first plate. Further advantageously, the lower surface of the pressing member is not projecting beyond the lower surface of the first plate. This may allow for smooth movement of the pressing member after the first plate is attached to the component-fixable member, facilitating position adjustment of the second plate.

In the adjustment mechanism, preferably, the first plate is movable relative to the component-fixable member in pivoting directions centered on a pivotal shaft in parallel with a vertical direction.

This disclosure may enable, in addition to position adjustment of the second plate to the first plate, position adjustment of the first plate to the component-fixable member. Therefore, position adjustment may be optionally exercised in directions along the surfaces of the component-fixable member, first plate, and second plate. Since the movement is centered on the pivotal shaft, position adjustment of the first plate may be achievable with fewer components.

Preferably, the adjustment mechanism further includes: a fixing portion, being disposed at one end part of the first plate, and the fixing portion serving to fix the second plate to the first plate.

In this disclosure, the second plate is pressed against the first plate and thereby fixed by two means; the fixing portion at one end part of the first plate, and the first biasing unit at the other end part of the first plate. Therefore, the first and second plates may be more securely fixable to each other after the position adjustment.

In the adjustment mechanism, preferably, the moving member is a pivotable cam pivotably attached to the first plate, and the pivotable cam is fixable to the first plate with a screw located on a pivoting center.

This disclosure using the pivotable cam as the moving member may confer the capacity for fine position adjustments. Further advantageously, fixing the pivotable cam may settle the position of the second plate, allowing the second plate to be easily fixed.

An adjustment method according to the present disclosure is an adjustment method for positionally adjusting and fixing a liquid discharge head to a component-fixable member, and the adjustment method includes: using an biasing unit directly or indirectly engageable with the liquid discharge head to prevent the liquid discharge head from lifting upward, and the biasing unit serving to bias the liquid discharge head in a predetermined direction; and moving the liquid discharge head directly or indirectly against an biasing force of the biasing unit to adjust the liquid discharge head in position.

In this disclosure, the position adjustment of the second plate, i.e., liquid discharge head, may be effected by way of adjustments using the moving member. Therefore, the number of components may be reduced and thus assembling can be readily performed, and the position adjustment thereby may be easier to perform.

This disclosure may provide for facilitated assembling and position adjustment.

DETAILED DESCRIPTION OF EMBODIMENTS

Embodiments of the adjustment mechanism and the adjustment method of the disclosure are hereinafter described in detail referring to the accompanying drawings. It should be understood that the adjustment mechanism and the adjustment method of the disclosure are not restricted in any aspects by these embodiments. Also, in components of the following embodiment, ones with which person skilled in the art can easily substitute the components, and ones which are substantially identical to the components are included.

Embodiments

Figure 1:
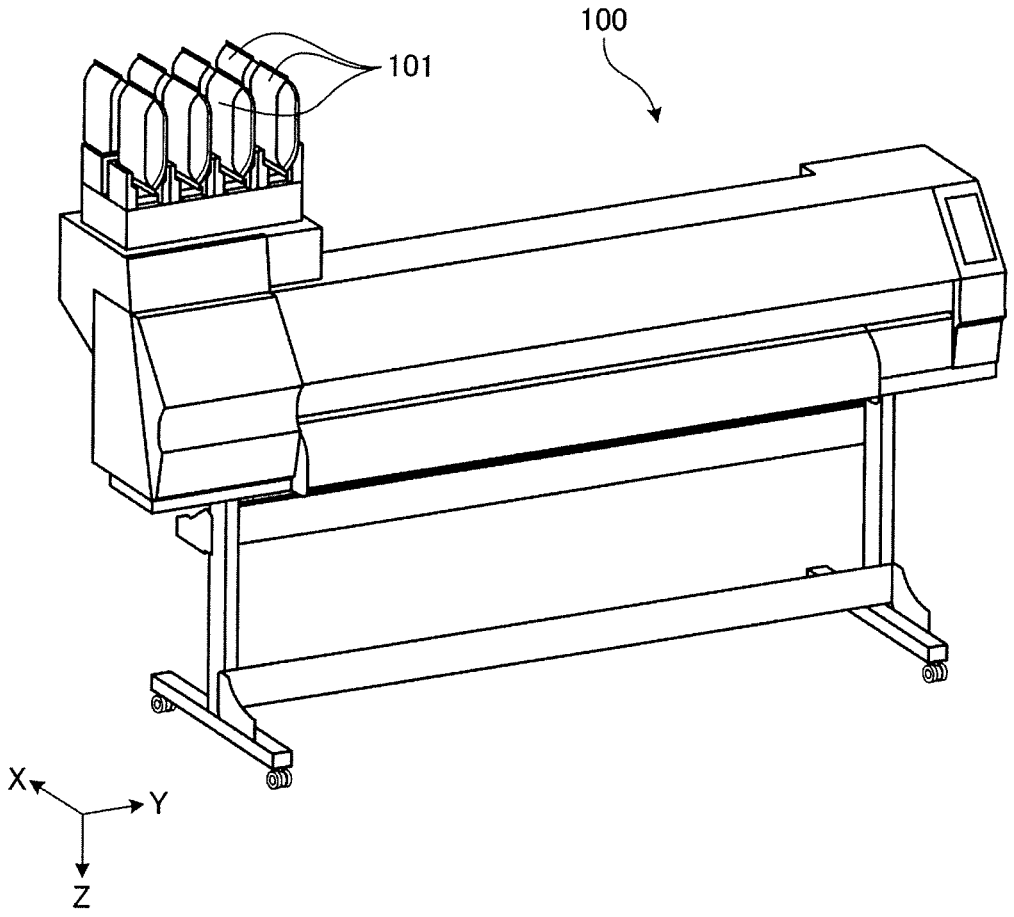
FIG. 1 is a perspective view of an exemplified structure of an inkjet printer equipped with an adjustment mechanism according to an embodiment.
Figure 2:
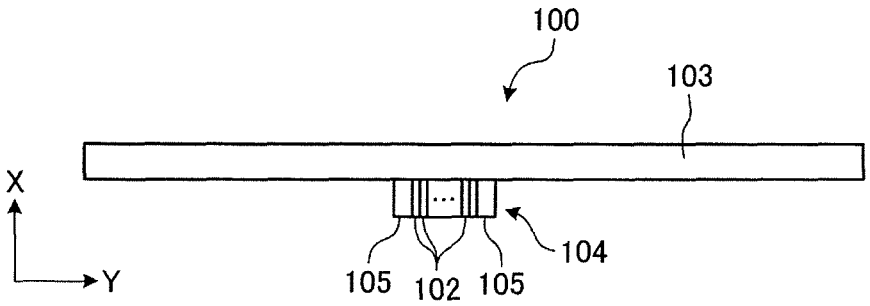
FIG. 2 is a schematic structural drawing of the inkjet printer equipped with the adjustment mechanism according to the embodiment.
Figure 3:
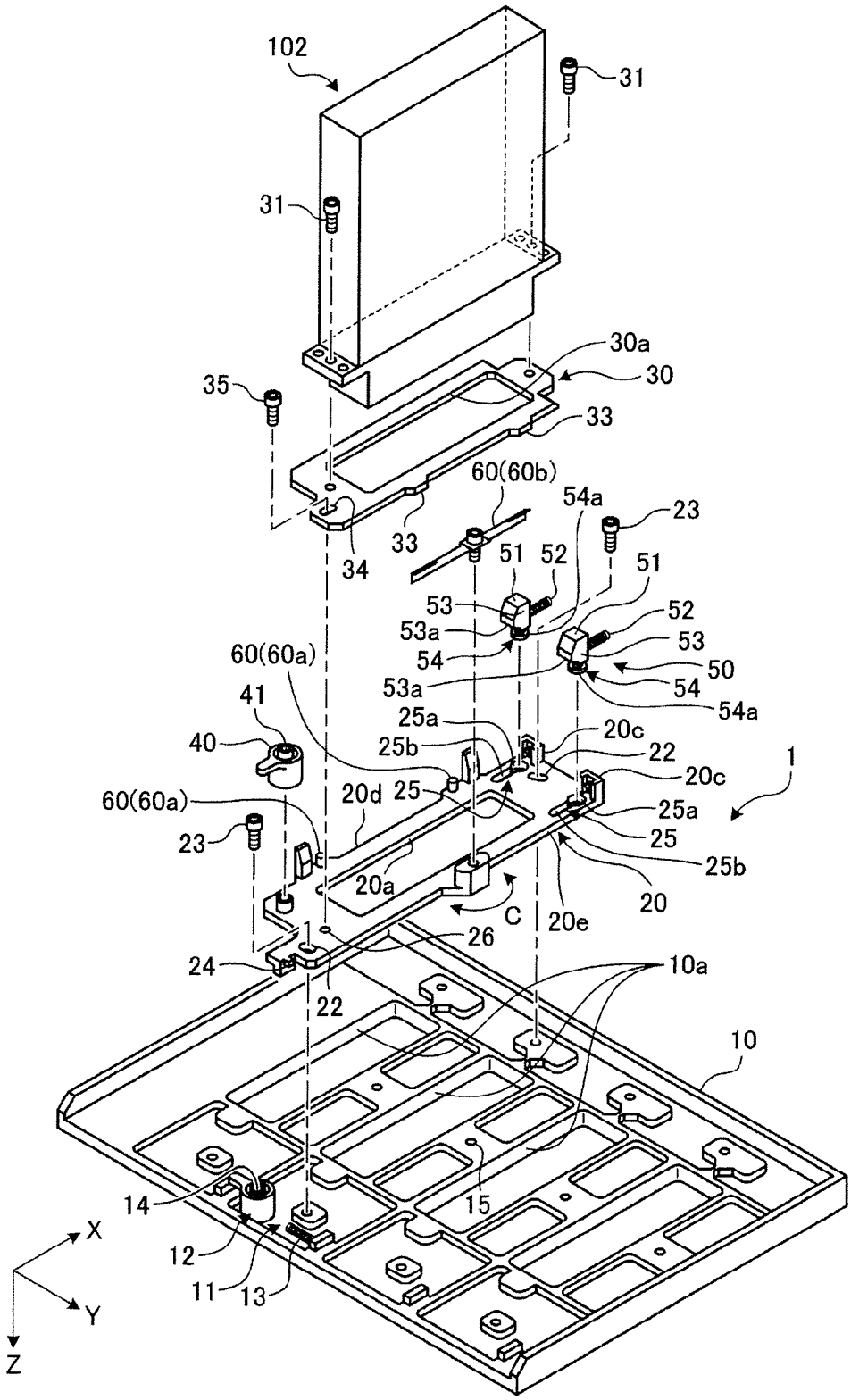
FIG. 3 is an exploded perspective view of the adjustment mechanism according to the embodiment.
Figure 4:
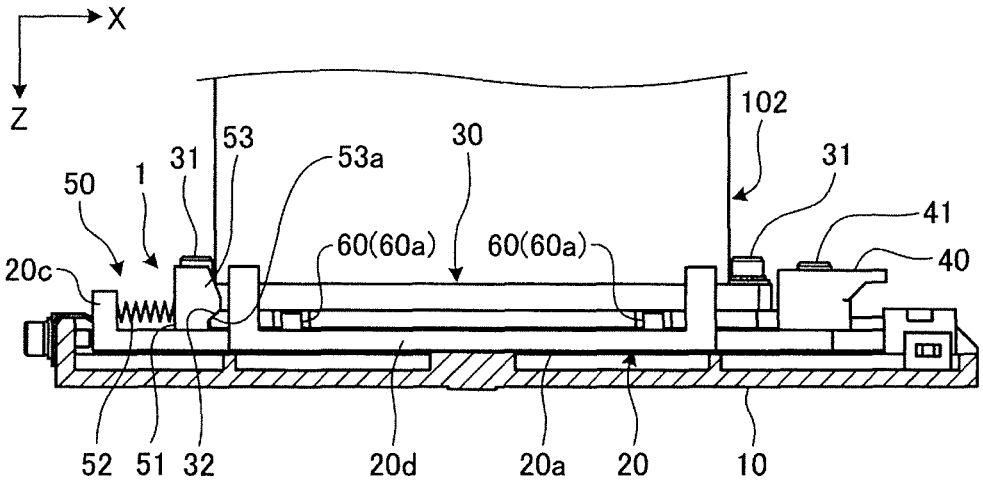
FIG. 4 is a side view in a sub scanning direction of the adjustment mechanism according to the embodiment.
Figure 5:
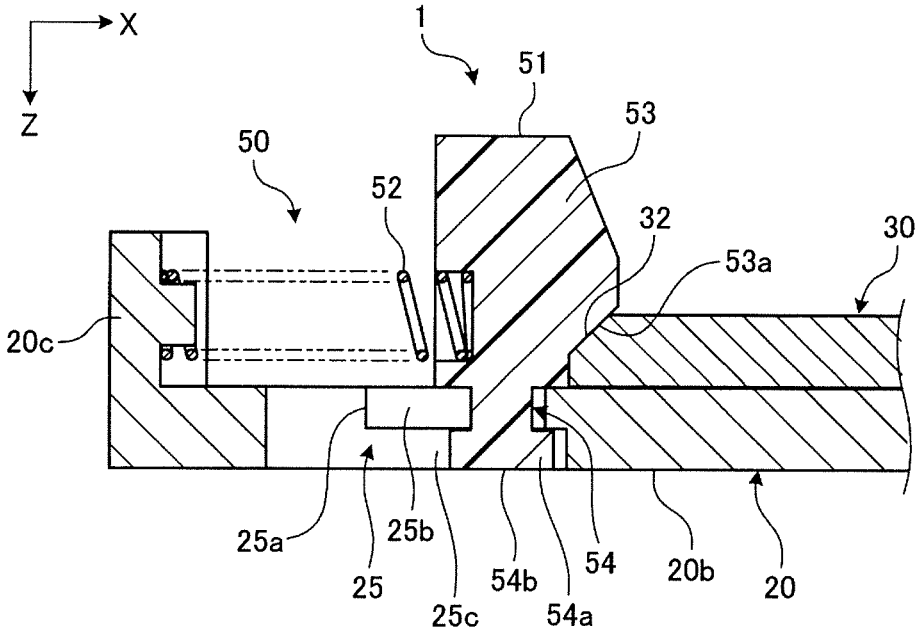
FIG. 5 is a cross-sectional view in the sub scanning direction of principal components of the adjustment mechanism according to the embodiment.
Figure 6:
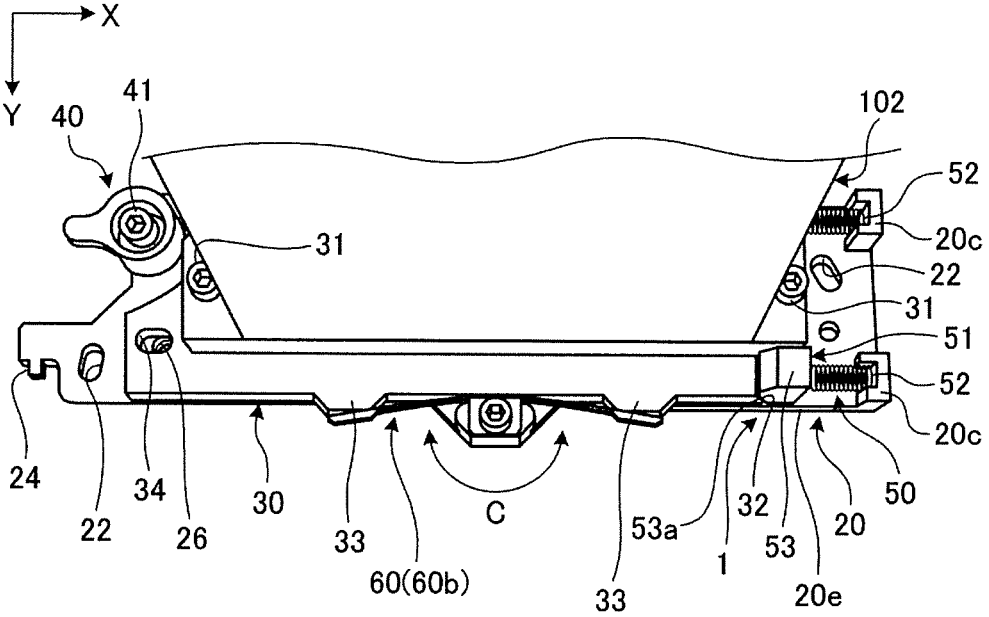
FIG. 6 is an upper perspective view of principal components of the adjustment mechanism according to the embodiment.
Figure 7:
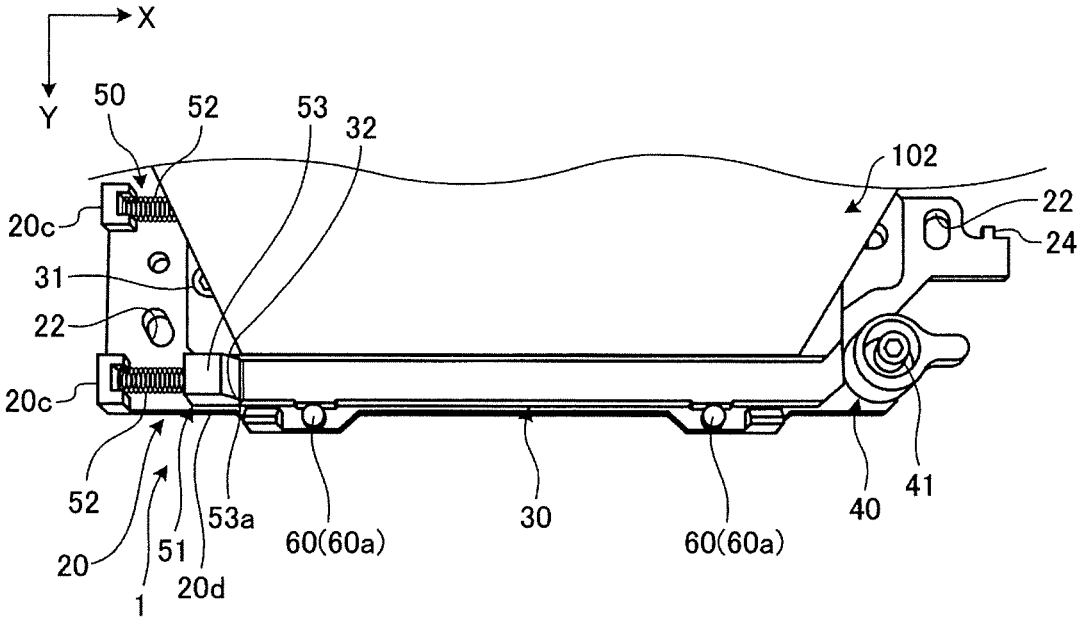
FIG. 7 is another upper perspective view of the principal components of the adjustment mechanism illustrated in FIG. 6.
Figure 8:
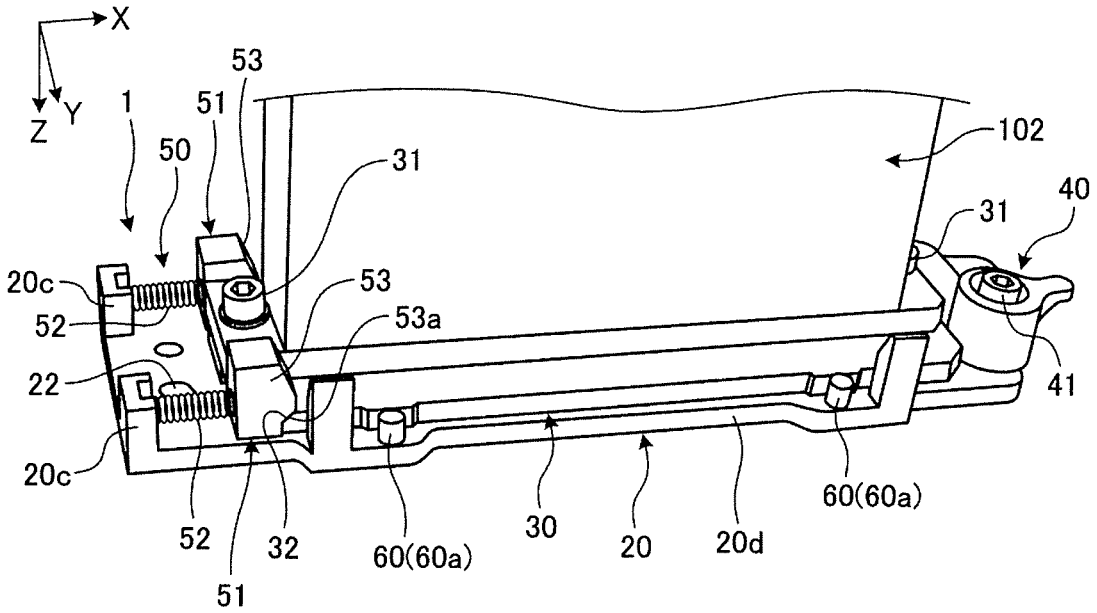
FIG. 8 is yet another perspective view of the principal components of the adjustment mechanism illustrated in FIG. 6.
Figure 9:
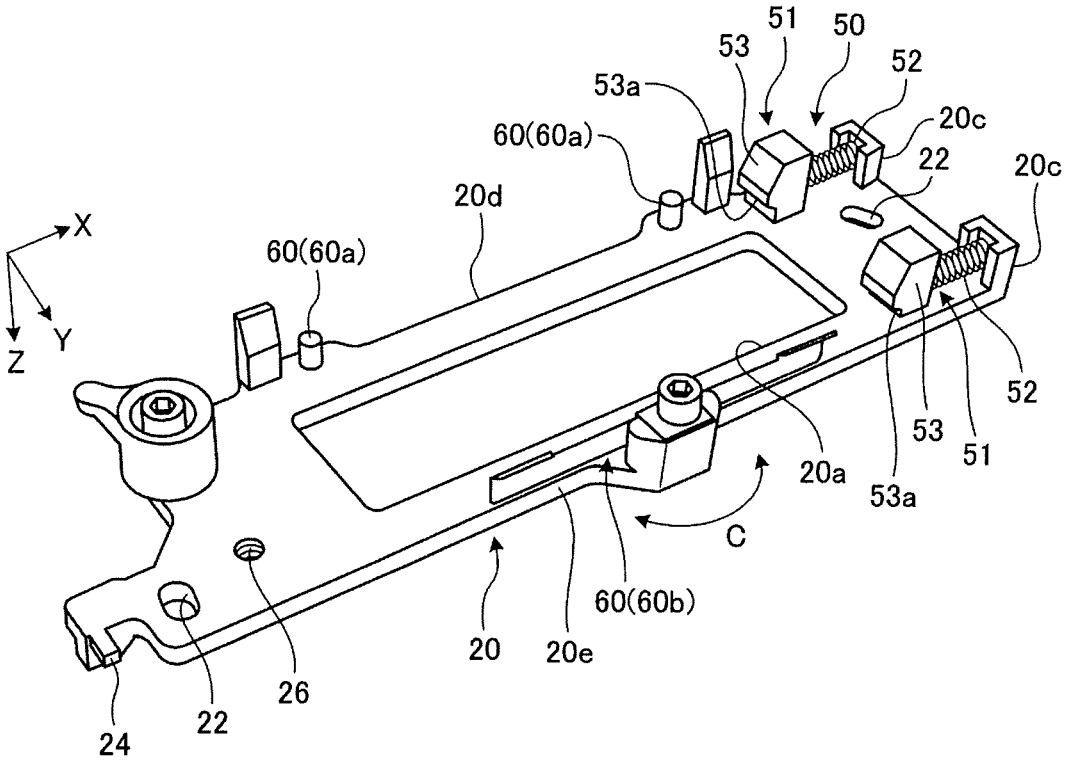
FIG. 9 is a perspective view of a first plate of the adjustment mechanism according to the embodiment.
Figure 10:
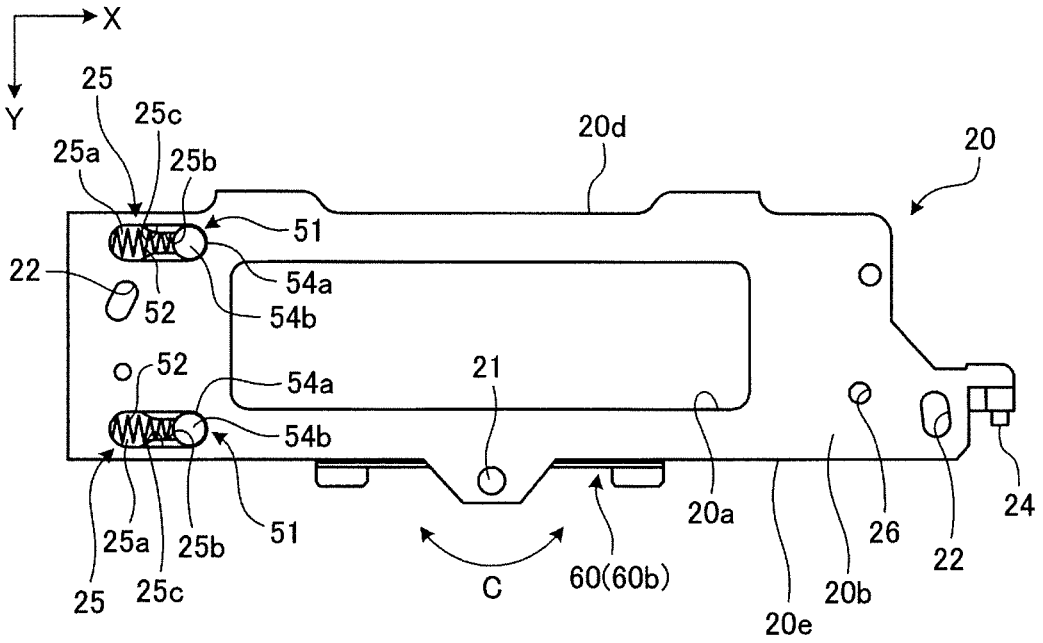
FIG. 10 is a bottom-side plan view of the first plate of the adjustment mechanism according to the embodiment.
Figure 11:
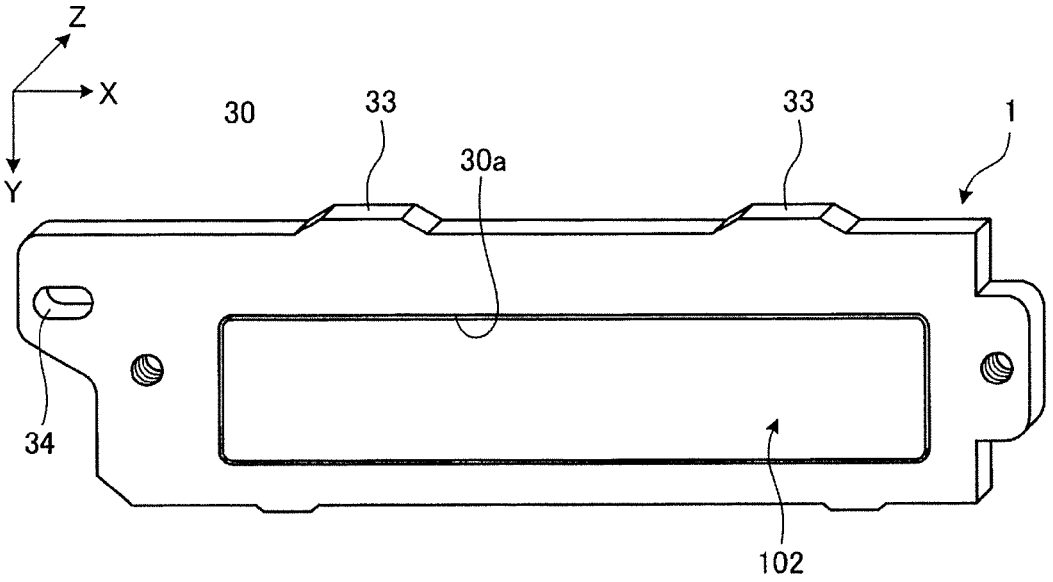
FIG. 11 is a bottom-side perspective view of a second plate, with a liquid discharge head fitted therein, of the adjustment mechanism according to the embodiment.
Figure 12:
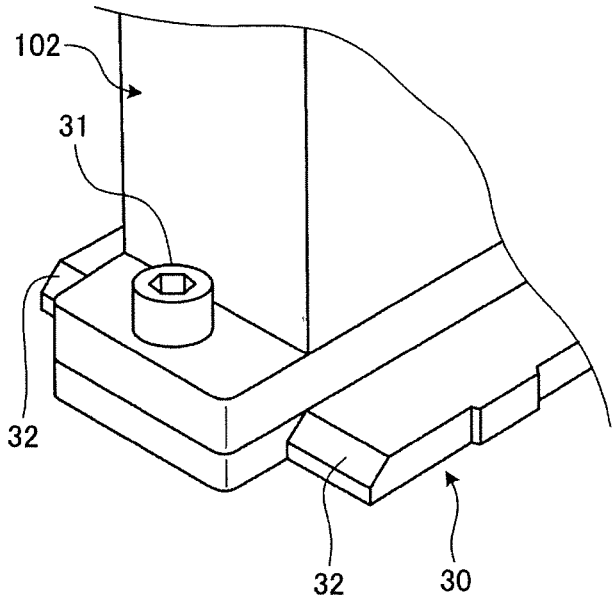
FIG. 12 is a perspective view of principal components of the second plate illustrated in FIG. 11.
Figure 13:
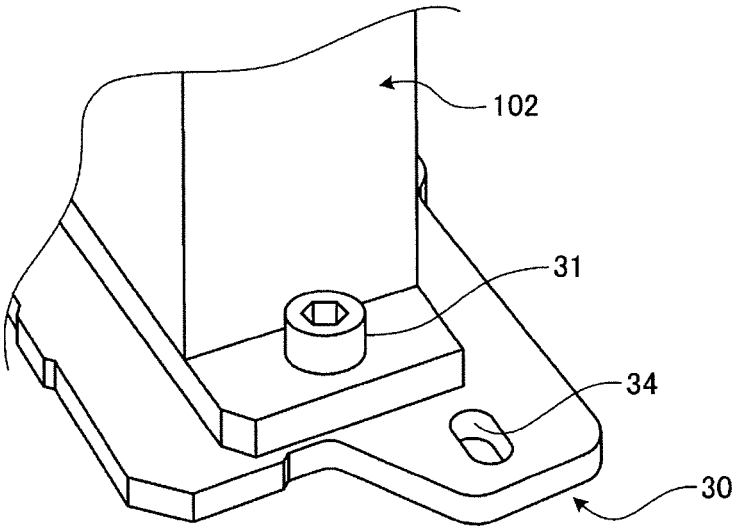
FIG. 13 is a perspective view of other principal components of the second plate illustrated in FIG. 11.

FIG. 1 is a perspective view of an exemplified structure of an inkjet printer equipped with an adjustment mechanism according to an embodiment. FIG. 2 is a schematic structural drawing of the inkjet printer equipped with the adjustment mechanism according to the embodiment. FIG. 3 is an exploded perspective view of the adjustment mechanism according to the embodiment. FIG. 4 is a side view in a sub scanning direction of the adjustment mechanism according to the embodiment. FIG. 5 is a cross-sectional view in the sub scanning direction of principal components of the adjustment mechanism according to the embodiment. FIG. 6 is an upper perspective view of principal components of the adjustment mechanism according to the embodiment. FIG. 7 is another upper perspective view of the principal components of the adjustment mechanism illustrated in FIG. 6. FIG. 8 is yet another perspective view of the principal components of the adjustment mechanism illustrated in FIG. 6. FIG. 9 is a perspective view of a first plate of the adjustment mechanism according to the embodiment. FIG. 10 is a bottom-side plan view of the first plate of the adjustment mechanism according to the embodiment. FIG. 11 is a bottom-side perspective view of a second plate, with a liquid discharge head fitted therein, of the adjustment mechanism according to the embodiment. FIG. 12 is a perspective view of principal components of the second plate illustrated in FIG. 11. FIG. 13 is a perspective view of other principal components of the second plate illustrated in FIG. 11.

An adjustment mechanism 1 according to the embodiment illustrated in FIG. 3 is installed and used in an inkjet printer 100 illustrated in FIGS. 1 and 2. The inkjet printer 100 prints a print object on a print medium as described below; liquid discharge heads 102 (illustrated in FIG. 3) that discharge inks fed from ink containers 101 (illustrated in FIG. 1) are reciprocated in a main scanning direction (corresponding to the second horizontal direction) in parallel with Y-axis direction; a print medium, not illustrated in the drawings, is moved along a sub scanning direction (corresponding to the first horizontal direction) in parallel with X-axis direction orthogonal to the main scanning direction; and the liquid discharge heads 102 are prompted to discharge the inks on the print medium. The inkjet printer 100 is a printer that prints a print object on a print medium using inkjet technique. Examples of the print medium may range in a variety of materials including rolled sheets.

As illustrated in FIG. 2, the inkjet printer 100 includes: a carriage 104 attached to a Y bar 103 movably in parallel with the main scanning direction; a carriage driving unit, not illustrated in the drawing, that reciprocates the carriage 104 in parallel with the main scanning direction; and a print medium moving unit, not illustrated in the drawing, that moves a print medium in the sub scanning direction.

The carriage 104 is allowed to reciprocate in the main scan direction along the linear Y bar 103. The carriage 104, reciprocating the liquid discharge heads 102 discharging inks and ultraviolet irradiators 105 irradiating ultraviolet light in the main scan direction, prints a print object on a print surface of the print medium. The carriage 104 is moved along the Y bar 103 in the main scanning direction. The carriage 104 has plural liquid discharge heads 102, and a pair of ultraviolet irradiators 105, as light exposure devices, on both sides of the plural liquid discharge heads 102 in the main scanning direction. The ultraviolet irradiators 105 can expose the inks discharged on the print medium to light. The ultraviolet irradiators 105 each include an LED module operable to irradiate ultraviolet light.

The liquid discharge heads 102 each have a plurality of ink discharge ports, not illustrated in the drawing, through which the ink in liquid form is discharged. The liquid discharge heads 102 are loaded to allow their ink discharge ports to discharge any one of inks in M (magenta), C (cyan), Y (yellow), and K (black) colors contained in the ink containers 101. The liquid discharge heads 102 discharge color inks through their ink discharge ports as required for an object to be printed. The liquid discharge heads 102 may discharge a group of color inks combined differently to the mentioned color inks. The ink discharge ports of the liquid discharge heads 102 may include printer heads facing the print medium to discharge the inks thereon, ink flow paths that connect the ink containers 101 to the printer heads, and regulators, pumps, and dampers disposed on the ink flow paths. In this embodiment, the liquid discharge heads 102 discharge inks changeable in a degree of cure by being exposed to ultraviolet light irradiated thereon.

As illustrated in FIG. 3, the liquid discharge heads 102 are each adjusted and fixed in position on a base plate 10 (corresponding to the component-fixable member) incorporated in the carriage 104 by an adjustment method carried out by the adjustment mechanism 1. The liquid discharge heads 102 are aligned on the base plate 10 along the main scanning direction. The liquid discharge heads 102 are situated with their ink discharge ports being aligned in parallel with the sub scanning direction. The inkjet printer 100 is equipped with the adjustment mechanisms 1 illustrated in FIG. 3.

The base plate 10 is made of a metal, formed in a planer shape and situated in parallel with the main and sub scanning directions, i.e., the horizontal direction. The base plate 10 has a plurality of openings 10*a* from which the ink discharge ports of the liquid discharge heads 102 are exposed. One each of the openings 10*a* is for one liquid discharge head 102. The ink discharge ports of the liquid discharge heads 102 are located on the inner sides of these openings to allow a print object to be printed on the print medium with the inks discharged through the ink discharge ports.

The adjustment mechanism 1 illustrated in FIG. 3 is structured to adjust and fix the liquid discharge head 102 in position on the base plate 10. There are plural adjustment mechanisms 1 that are each provided for one of the liquid discharge heads 102. The plural adjustment mechanisms 1 are mounted on the base plate 10. These adjustment mechanisms 1 respectively adjust and fix the positions of the associated liquid discharge heads 102 on the base plate 10.

As illustrated in FIG. 3, the adjustment mechanism 1 has a first plate 20, a second plate 30, a pivotable cam 40 (corresponding to the moving member), a first biasing unit 50, and a plurality of support members 60.

The first plate 20 is fixed to the base plate 10. The first plate 20 is made of a metal in the form of a rectangular frame. The first plate 20 is situated with its longitudinal direction in parallel with the main scanning direction, and then fixed to the base plate 10 so that an inner opening 20*a* of the first plate 20 communicates with the opening 10*a* of the base plate 10. The first plate 20 has a pivotal shaft 21. The pivotal shaft 21 is located in a central part of the first plate 20 in the sub scanning direction at a lower end thereof in the main scanning direction in FIG. 10. The first plate 20 is changeable in position in a circumferential direction C centered on the pivotal shaft 21 (illustrated with an arrow in FIG. 10; corresponding to the horizontal direction). The pivotal shaft 21 has a cylindrical shape in parallel with Z-axis direction (or vertical direction) orthogonal to both of the main and sub scanning directions. The pivotal shaft 21 is projecting from the first plate 20 toward the base plate 10. The pivotal shaft 21 is inserted in a hole 15 (illustrated in FIG. 3) forming in the base plate 10 to allow the first plate 20 to be movable in the circumferential direction C relative to the base plate 10. Thus, the first plate 20 is movable, relative to the base plate 10, in the circumferential direction C centered on the pivotal shaft 21 in parallel with the vertical direction (corresponding to the pivoting directions).

The first plate 20 has elongated holes 22 at its one end part and the other end part in the sub scanning direction. The first plate 20 is fixed to the base plate 10 by inserting screws 23 in the elongated holes 22 and threading them into the base plate 10. The elongated holes 22 are penetrating through the first plate 20 and extending in the circumferential direction C centered on the pivotal shaft 21. By changing positions of the elongated holes 22 at which the screws 23 are inserted through, the position of the first plate 20 is adjustable relative to the base plate 10 in the circumferential direction C centered on the pivotal shaft 21.

The first plate 20 is adjusted in position in the circumferential direction C centered on the pivotal shaft 21 by a base-side adjustment mechanism 11. The base-side adjustment mechanism 11 has a base-side pivotable cam 12 and a spring 13. The base-side pivotable cam 12 is formed on the base plate 10 in vicinity of one end part of the first plate 20 and pivotable around the pivoting center in parallel with the vertical direction. The spring 13 biases one end part of the first plate 20 toward the base-side pivotable cam 12. The base-side pivotable cam 12 has an outer peripheral surface, serving as a cam face eccentric to the pivoting center in parallel with the vertical direction and abutting one end part of the first plate 20. By having a screw 14 located at the pivoting center be threaded into the base plate 10, the base-side pivotable cam 12 is fixed to the base plate 10.

The spring 13, with its one end fixed to the base plate 10, is situated in parallel with the main scanning direction. The base plate 10 has a spring-insertable projection 24 (illustrated in FIGS. 9 and 10) at one end part thereof. The spring-insertable projection 24 is inserted in the other end part of the spring 13 to bias one end part of the base plate 10 toward the cam face of the base-side pivotable cam 12.

In the base-side adjustment mechanism 11, the screws 23 are inserted in the elongated holes 22 and threaded into the base plate 10, with the first plate 20 still being allowed to change in position in the circumferential direction C centered on the pivotal shaft 21. Then, one end part of the first plate 20 is abutted against the cam face of the base-side pivotable cam 12. In the base-side adjustment mechanism 11, the base-side pivotable cam 12 is pivotally turned to adjust the first plate 20 in position in the circumferential direction C centered on the pivotal shaft 21. In the base-side adjustment mechanism 11, when the position of the first plate 20 in the circumferential direction C centered on the pivotal shaft 21 falls on a regular position, the screw 14 is threaded into the base plate 10 to fix the base-side pivotable cam 12 to the base plate 10, and the screws 23 are inserted in the elongated holes 22 and threaded into the base plate 10 to fix the first plate 20 to the base plate 10.

The second plate 30 is mounted on the first plate 20 movably relative to the first plate 20 in the sub scanning direction different from the circumferential direction C. The second plate 30 is made of a metal in the form of a rectangular frame. The second plate 30 is situated with its longitudinal direction in parallel with the sub scanning direction, and then mounted on the first plate 20 so that an inner opening 30*a* of the second plate 30 communicates with the opening 20*a* of the first plate 20 and the opening 10*a* of the base plate 10. The liquid discharge head 102 is fitted in the second plate 30 with their ink discharge ports being located in the opening 30*a*. Then, screws 31 are threaded into both end parts of the second plate 30 to fix the liquid discharge head 102.

The other end part of the second plate 30 in the sub scanning direction located on the other end part of the first plate 20 has tapered faces 32 as illustrated in FIGS. 4, 5, 8, and 12. The tapered faces 32 are formed by reducing the second plate 30 in thickness by degrees in parallel with the sub scanning direction toward the outer side of the second plate 30. The tapered faces 32 are inclined toward the first plate 20. The tapered face 32 constitute the lift-off preventer, serving to prevent the second plate 30, in collaboration with presser parts 53 described later, from lifting upward off the first plate 20.

The pivotable cam 40 is attached to one end part of the first plate 20 to press and move the second plate 30 in the sub scanning direction, as the before-mentioned different direction, against the biasing force of the first biasing unit 50 described later. The pivotable cam 40 is attached to one end part of the first plate 20 pivotably around the pivoting center in parallel with the vertical direction, and then provided at the other end part of the second plate 30. The pivotable cam 40 has an outer peripheral surface, serving as a cam face eccentric to the pivoting center in parallel with the vertical direction and abutting the other end part of the second plate 30. The pivotable cam 40, by being pivotally turned with the other end part of the second plate 30 abutting its cam face, presses and moves the second plate 30 in the sub scanning direction. The pivotable cam 40 is allowed to locate the other end part of the second plate 30 by inviting the other end part of the second plate 30 to abut the cam face of the pivotable cam 40 at a predetermined position thereof. By having a screw 41 located at the pivoting center be threaded into the first plate 20, the pivotable cam 40 is fixed to the first plate 20. The pivotable cam 40 is, therefore, freely pivotable relative to the first plate 20 before the screw 41 is threaded into the first plate 20.

The first biasing unit 50 is attached to the other end part of the first plate 20. The first biasing unit 50 biases the second plate 30 toward the pivotable cam 40 along the sub scanning direction and also presses the second plate 30 against the first plate 20. As illustrated in FIGS. 3, 4, 5, 6, 7, 8, and 9, the first biasing unit 50 has a pair of pressing members 51 and a pair of coil springs 52 (corresponding to the biasing force generator).

The pair of pressing members 51 presses the second plate 30 toward the pivotable cam 40 along the sub scanning direction. These pressing members 51 are slidably attached to the first plate 20 along the sub scanning direction through slide grooves 25 (illustrated in FIGS. 3 and 5) formed in the other end part of the first plate 20. The paired pressing members 51, spaced at an interval in the main scanning direction, are supported on the first plate 20. The pressing members 51 each have a presser part 53 that presses the second plate 30, and a slide column 54 formed in continuity with the presser part 53 and vertically protruding toward the first plate 20.

The presser part 53 has a presser face 53*a* that can be abutted against the tapered face 32. The presser part 53 functions as the lift-off preventer constituting the first biasing unit 50. The presser parts 53 are biased toward the pivotable cam 40 to press the tapered faces 32 and thereby press the second plate 30 toward the pivotable cam 40. The presser part 53 further pushes the second plate 30 against the first plate 20 to prevent the second plate 30 from lifting upward. The lift-off preventer provided by this embodiment presses the second plate 30 against the first plate 20 using an biasing force directed downward. The lift-off preventing function does not necessarily rely on the biasing force. For instance, providing projections may be an option, in which case the target plate is thereby constrained from lifting upward above a certain level. The slide column 54 has a columnar shape in parallel with the vertical direction. The slide columns 54 each have a flange 54*a*, at a lower end part thereof, projecting in its outer-peripheral direction. The flange 54*a* has a round shape in plan view. The slide columns 54 have a length equal to the thickness of the second plate 30.

The slide grooves 25 are formed to slidably attach the pressing members 51 to the first plate 20 along the sub scanning direction. Additionally, the slide grooves 25 serve the purpose of preventing the pressing members 51 from falling off the first plate 20. The slide grooves 25, spaced at an interval in the main scanning direction, are formed in the other end part of the first plate 20. The slide grooves 25 are penetrating through the first plate 20 and linearly extending along the sub scanning direction. As illustrated in FIGS. 3 and 5, the slide grooves 25 each have a large aperture 25*a* formed at a position most distant from the pivotable cam 40, and a width-reduced part 25*b* extending from the large aperture 25*a* toward the pivotable cam 40. The large aperture 25*a* has a round shape in plan view, and its inner diameter is slightly greater than the outer diameter of the flange 54*a*. The width of the width-reduced part 25*b* in the main scanning direction is smaller than the inner diameter of the large aperture 25*a* and slightly greater than the outer diameter of the slide column 54. The slide grooves 25 each have a stepped part 25*c* continuous to the width-reduced part 25*b* on a side thereof closer to the lower surface of the second plate 30 mounted on the first plate 20. The width of the stepped part 25*c* in the main scanning direction is greater than the width of the width-reduced part 25*b* and greater than the outer diameter of the flange 54*a*.

The slide columns 54 are inserted through the large apertures 25*a* of the slide grooves 25 to attach the pressing members 51 to the other end part of the first plate 20. By sliding the slide columns 54 inserted in the slide grooves 25 toward the pivotable cam 40 to be fitted in the width-reduced parts 25*b*, the flange parts 54*a* are located in the stepped parts 25*c*. By fitting the slide columns 54 in the width-reduced parts 25*b*, the pressing members 51 are fitted in the slide grooves 25 slidably in the sub scanning direction. Whenever the pressing members 51 attempt to move upward, the flanges 54*a* located in the stepped parts 25*c* of the slide grooves 25 get stuck in the width-reduced parts 25*b*, thereby preventing the pressing members 51 from falling off the first plate 20. The flanges 54*a* have a thickness substantially equal to the height of the stepped parts 25*c*. Therefore, lower surfaces 54*b* of the flanges 54*a* of the pressing members 51 are flush with a lower surface 20*b* of the first plate 20. As such, the base plate 10 abutting the lower surface 20*b* of the first plate 20 does not pose the risk of interference with the sliding movements of the pressing members 51 in the slide grooves 25. In this disclosure, the lower surfaces 54*b* of the flanges 54*a* of the pressing members 51 may be above the level of the lower surface 20*b* of the first plate 20.

The coil springs 52 bias the pressing members 51 toward the second plate 30 along the sub scanning direction. The coil springs 52 are each located between the pressing member 51 and an upright piece 20*c* protruding upward from the other end part of the first plate 20 to bias the pressing member 51 toward the second plate 30, i.e., pivotable cam 40. The coil springs 52 bias the pressing members 51, thereby biasing the second plate 30 toward the pivotable cam 40 and pushing the second plate 30 against the first plate 20.

In this embodiment, the first biasing unit 50 is composed of two separate members; pressing member 51 and coil spring 52. The first biasing unit 50 may be composed of an integrally formed member. For instance, a support wall is vertically disposed in vicinity of the opening 20*a* on the opposite side of the pivotable cam 40 of the first plate 20, a fitting member, formed by a metal plate member having a substantially U shape in cross section, is attached to the support wall in a manner that three sides of the cross-sectionally U-shaped plate member surround the opposite end part of the second plate 30 where the pivotable cam 40 is located, a lift-off preventer in the form of a projection that prevents the second plate 30 from lifting off is disposed on each of parallel two sides among three sides of the fitting member, and the remaining one side of the fitting member is attached to the support wall as an biasing member in the form of a leaf spring that biases the second plate 30 in the horizontal direction. Then, the first biasing unit 50 may be ready for use by simply attaching the fitting member to the support wall and fitting the second plate 30 in the fitting member.

There are plural support members 60 on the first plate 20 in parallel with the vertical direction extending from the first plate 20 toward the liquid discharge heads 102. In this embodiment, there are two support members 60 on a long-side part 20*d* of the first plate 20 illustrated on the far side in FIGS. 3 and 9, and one support member 60 on a long-side part 20*e* of the first plate 20 illustrated on the near side in FIGS. 3 and 9. The two support members 60 on the long-side part 20*d* of the first plate 20 illustrated on the far side in FIGS. 3 and 9 (corresponding to the other support member; hereinafter indicated with a reference sign 60*a*) are respectively disposed at one end part and the other end part of the first plate 20. The support member 60 on the long-side part 20*e* of the first plate 20 illustrated on the near side in FIGS. 3 and 9 (corresponding to one of the support members; hereinafter indicated with a reference sign 60*b*) is disposed at a center part of the first plate 20 in the sub scanning direction.

The support members 60*a* and the support member 60*b* are thus provided on the first plate 20 and spaced at an interval in the main scanning direction. The second plate 30 is located between the support members 60*a* and the support member 60*b*. The support members 60*a* and the support member 60*b*, with the second plate 30 being located therebetween, regulate movement of the second plate 30 in the main scanning direction, i.e., the before-mentioned different direction. The second plate 30, located between the support members 60*a* and the support member 60*b*, is adjusted in position in the sub scanning direction by the pivotable cam 40.

The support member 60*b* is a second biasing unit that biases the second plate 30 in the main scanning direction toward the support members 60*a*. The support member 60*b*, serving as the second biasing unit, is a leaf spring with its longitudinal direction in parallel with the sub scanning direction. The central part of the support member 60*b* in the sub scanning direction is fixed to the first plate 20. The support member 60*b*, serving as the second biasing unit, using its both ends in the sub scanning direction, presses projections 33 (illustrated in FIGS. 6 and 11) of the second plate 30 in the main scanning direction.

As illustrated in FIGS. 3 and 9, the adjustment mechanism 1 further has a threaded hole 26 (corresponding to the fixing portion). The threaded hole 26 is formed in one end part of the first plate 20 to fix the second plate 30 to the first plate 20. A screw 35 (illustrated in FIG. 3) is inserted in a through hole 34 (illustrated in FIG. 13) penetrating through the other end part of the second plate 30 and threaded into the threaded hole 26 to fix the second plate 30 to one end part of the first plate 20.

In the adjustment mechanism 1 thus structurally characterized, the liquid discharge head 102 is attached to the base plate 10 as hereinafter described. First, the second plate 30 is fitted with the liquid discharge head 102 as illustrated in FIGS. 11, 12, and 13. Then, the second plate 30, with the liquid discharge head 102 fitted therein, is placed on the first plate 20 mounted with the pivotable cam 40, first biasing unit 50, and support member 60*b*, i.e., second biasing unit, as illustrated in FIGS. 6, 7, and 8. At the time, the second plate 30 is located between the pressing members 51 of the first biasing unit 50 and the pivotable cam 40, and also located between the support member 60*b*, i.e., second biasing unit, and the support members 60*a*. Further, the screw 41 of the pivotable cam 40 is loosened.

As a result, the second plate 30 is held between the support members 60*a* and the support member 60*b* by the biasing force of the support member 60*b*, i.e., second biasing unit, and the second plate 30 is biased toward the pivotable cam 40 by the biasing force of the first biasing unit 50. Further, the second plate 30 is pushed against the first plate 20 by the presser faces 53*a* and the tapered faces 32. Then, the pivotable cam 40 is pivotally turned to adjust the second plate 30 in position in the sub scanning direction. In the adjustment mechanism 1, when the position of the second plate 30 in the sub scanning direction falls on a regular position, the screw 41 is threaded into the first plate 20 to fix the pivotable can 40 to the first plate 20. After the position of the first plate 20 is adjusted by the base-side adjustment mechanism 11, the first plate 20 is fixed to the base plate 10. By fixing the first plate 20 to the base plate 10, the first plate 20, second plate 30, and liquid discharge head 102 are resultantly fixed to the base plate 10.

The second plate 30 substantially rectangular in plan view is biased by the first biasing unit 50 and the second biasing unit 60*b* from two adjacent sides toward a corner nearby where the pivotable cam 40 is located. The second plate 30 may be recurrently mounted on and dismounted from the first plate 20. Yet, thus using two biasing units may ensure good positioning accuracy. Further advantageously, the second plate 30 pushed and fixed under the biasing forces of these two biasing units may be removed rather easily from the first plate 20 by moving the second plate 30 against the biasing forces.

The adjustment mechanism 1 according to the embodiment described so far has, at one end part of the first plate 20, the pivotable cam 40 that moves and locates the second plate 30 in the sub scanning direction. The adjustment mechanism 1 further has, at the other end part of the first plate 20, the first biasing unit 50 that biases the second plate 30 toward the pivotable cam 40 and pushes the second plate 30 against the first plate 20. In the adjustment mechanism 1, wherein the second plate 30 is biased by the first biasing unit 50 toward the pivotable cam 40 and the first plate 20, the second plate 30 may be prevented from lifting off the first plate 20. Furthermore, the second plate 30 is moved by way of the pivotable cam 40 against the biasing force of the first biasing unit 50 and thereby adjusted and located in position. In this manner, position adjustment of the second plate 30, i.e., liquid discharge head 102, may be successfully exercised. In the adjustment mechanism 1, therefore, position adjustment of the second plate 30, i.e., liquid discharge head 102, may be effected by way of adjustments using the pivotable cam 40. As a result, the number of components may be reduced and thus assembling can be readily performed, and the position adjustment thereby may be easier to perform.

In the adjustment mechanism 1, while the first biasing unit 50 presses the second plate 30 in the sub scanning direction toward the first plate 20, the second plate 30 is supported between the support members 60*a* and the support member 60*b*. Hence, fine position adjustments of the second plate 30 by way of the pivotable cam 40 are exercised in the sub scanning direction. This may enhance reliability in position adjustment of the second plate 30.

In the adjustment mechanism 1, the second plate 30 is held between the support member 60*b* as the second biasing unit and the support members 60*a*. Then, movements of the second plate 30 along the main scanning direction may be certainly regulated irrespective of dimensional accuracy of the second plate 30. The first biasing unit 50 biases the second plate 30 in the sub scanning direction, and the support member 60*b*, second biasing unit, biases the second plate 30 in the main scanning direction. These biasing actions may allow the position of the second plate 30 to be more reliably settled relative to the first plate 20, leading to an improved positioning accuracy of the liquid discharge head 102.

In the adjustment mechanism 1, the pressing members 51 constituting the first biasing unit 50 are slidably attached to the first plate 20 through the slide grooves 25 and prevented from falling off by the slide grooves 25. The pressing members 51 thus arranged may more certainly press the second plate 30 toward the first plate 20. Further advantageously, the lower surfaces 54*b* of the pressing members 51 are not projecting beyond the lower surface 20*b* of the first plate 20. This may allow the pressing members 51 to smoothly move, with the first plate 20 being attached to the base plate 10, facilitating position adjustment of the second plate 30. The first plate 20 is mounted on the base plate 10, and the second plate 30 is mounted on the first plate 20. Because of this stacked configuration, the slide grooves 25 for locating the pressing members 51 that bias the second plate 30 may be formed in the first plate 20. This makes it easier than processing the base plate 10 to provide a scheme for locating the pressing members 51, and further makes it unnecessary to form a through hole in the base plate 10, thus reducing the risk of ink splashes flying off into the carriage 104.

The adjustment mechanism 1 may enable position adjustment of the first plate 20 to the base plate 10 in addition to position adjustment of the second plate 30 to the first plate 20. Therefore, position adjustment may be optionally exercised in directions along the surfaces of the base plate 10, first plate 20, and second plate 30. In the adjustment mechanism 1 wherein position changes of the first plate 20 are exercised by way of the pivotal shaft 21, the first plate 20 may be positionally adjustable with fewer components.

In this adjustment mechanism 1, the screw 35 threaded into the threaded hole 26 formed in one end part of the first plate 20 and the first biasing unit 50 attached to the other end part of the first plate 20 both push the second plate 30 against the first plate 20 and then fix the second plate 30. Thus, the positionally adjusted first and second plates 20 and 30 may be more reliably fixable to each other.

This disclosure using the pivotable cam 40 as the moving member may confer the capacity for fine position adjustments. Further advantageously, fixing the pivotable cam 40 may settle the position of the second plate 30, allowing the second plate 30 to be easily fixed.

In the adjustment mechanism 1, the first plate 20, second plate 30, and liquid discharge head 102 are assembled together. This may facilitate assembling and removal of these components, reducing any space required for assembling and thereby saving more space for a carriage 104 and, possibly, other components.

The described embodiment exemplifies the support member 60*b* as the second biasing unit. This disclosure includes configuring the support members 60*a* and 60*b* both to act as the second biasing unit that biases the second plate 30 in the main scanning direction. In summary, this disclosure may be effective in so far as at least one of the support members 60*a* or the support member 60*b* acts as the second biasing unit that biases the second plate 30 along the second horizontal direction toward the other support member(s).

What is claimed is:

1. An adjustment mechanism for positionally adjusting and fixing a liquid discharge head to a component-fixable member, comprising:

a first plate, being changeable in position in a horizontal direction relative to the component-fixable member, and the first plate is fixable to the component-fixable member;

a second plate, being mountable on the first plate and movable in the horizontal direction relative to the first plate, and the second plate being structured to have the liquid discharge head be securely fitted therein;

a first biasing unit, being attachable to one end part of the second plate, and the first biasing unit having a lift-off preventer operable to bias the second plate in the horizontal direction and to deter the second plate from lifting upward off the first plate; and a moving member, being attachable to another end part of the second plate, and the moving member being operable to move the second plate against a biasing force of the first biasing unit and to locate the another end part;

wherein the first biasing unit comprises:

a pressing member that presses the second plate; and an biasing force generator that biases the pressing member toward the second plate, wherein the pressing member is slidably attachable to the first plate along the horizontal direction through a slide groove formed in the first plate, the pressing member being prevented from falling off the first plate by the slide groove.

2. The adjustment mechanism according to claim 1, wherein the second plate with the liquid discharge head fitted therein is mounted on the first plate, and the first plate is mounted on the component-fixable member so as to have the first plate, the second plate, and the liquid discharge head be fixed to the component-fixable member.

3. The adjustment mechanism according to claim 1, further comprising:

support members, being disposed on the first plate and spaced at an interval along a second horizontal direction intersecting with the direction in which the second plate is moved by the moving member, and the support members having the second plate be located therebetween to regulate movement of the second plate in the second horizontal direction, wherein the second plate is adjusted in position in the horizontal direction by the moving member between the support members spaced at an interval along the second horizontal direction.

4. The adjustment mechanism according to claim 2, further comprising:

support members, being disposed on the first plate and spaced at an interval along a second horizontal direction intersecting with the direction in which the second plate is moved by the moving member, and the support members having the second plate be located therebetween to regulate movement of the second plate in the second horizontal direction, wherein the second plate is adjusted in position in the horizontal direction by the moving member between the support members spaced at an interval along the second horizontal direction.

5. The adjustment mechanism according to claim 3, wherein at least one of the support members spaced at an interval along the second horizontal direction is a second biasing unit that biases the second plate toward the other support member along the second horizontal direction.

6. The adjustment mechanism according to claim 1, wherein a lower surface of the pressing member is flush with a lower surface of the first plate or above a level of the lower surface of the first plate.

7. The adjustment mechanism according to claim 1, wherein the first plate is movable relative to the component-fixable member in pivoting directions centered on a pivotal shaft in parallel with a vertical direction.

8. The adjustment mechanism according to claim 1, further comprising:

a fixing portion, being disposed at one end part of the first plate, and the fixing portion serving to fix the second plate to the first plate.

9. The adjustment mechanism according to claim 1, wherein the moving member is a pivotable cam pivotably attached to the first plate, and the pivotable cam is fixable to the first plate with a screw located on a pivoting center.

* * * * *